US005704511A

United States Patent [19]

Kellams

[11] Patent Number: 5,704,511

[45] Date of Patent: Jan. 6, 1998

[54] WASTE CAN WITH BAG DISPENSER AND REMOVABLE LINER

[76] Inventor: Kelly Kellams, 740 B Alyeska, Kodiak, Ak. 99615

[21] Appl. No.: 647,134

[22] Filed: May 9, 1996

[51] Int. Cl.[6] ..... B65D 85/50

[52] U.S. Cl. ..... 220/407; 220/404

[58] Field of Search ..... 220/410, 4.03, 220/407, 403, 404

[56] References Cited

U.S. PATENT DOCUMENTS

| | | | |
|---|---|---|---|
| 2,665,552 | 12/1954 | Sider et al. | 220/410 |
| 3,256,441 | 6/1966 | Grasty | 220/410 |
| 3,516,596 | 6/1970 | Madden et al. | 220/410 |
| 3,990,179 | 11/1976 | Johnson et al. | 220/4.03 |
| 4,852,757 | 8/1989 | Gold | 220/4.03 |
| 4,998,967 | 3/1991 | Box | 220/4.03 |
| 5,060,799 | 10/1991 | De Pagter | 220/4.03 |

*Primary Examiner*—Joseph M. Moy
*Attorney, Agent, or Firm*—Michael J. Tavella

[57] ABSTRACT

A new form of trash receptacle that has an outer frame and a hinged lid. At the bottom of the outer frame is a housing designed to hold a large roll of plastic trash bags. The bottom of the housing is fitted with a space to accommodate the lid-lifting mechanism. At the top of the bag housing is a platform that supports a removable inner lining. The lower part of the lining is a rectangular box with a solid bottom and an open top. On top of this box is another rectangular box that has an open top and an open bottom. The top box is designed to interlock with the lower box. New bags are dispensed from the roll through a slot in the back of the frame. A new bag is torn off and the supply of bags remains in this slot ready for the next replacement. Two sets of bag holders hold the new bag in place.

19 Claims, 10 Drawing Sheets

WASTE CAN WITH BAG DISPENSER AND REMOVABLE LINER

This invention relates to waste cans and particularly to waste cans with a bag dispenser and removable liners.

BACKGROUND OF THE INVENTION

Waste cans have been use for many years. First, most cans are used with thin plastic bags as temporary liners. The bags hold refuse and when full, can be tied off, removed and discarded, leaving a relatively clean can. The can then be lined with another plastic bag. Despite the utility of the basic can and plastic liner, three problems exist. First, there is no convenient way of storing bags in the waste can that allows the user to quickly get a new bag. Second, once the new bag is found and placed in the can, there is often no way to secure the bag to the can so that it does not fall into the can. Most often, the top of the bag is tied with a knot, which temporarily binds the bag to the can. The third problem occurs when bags spill their contents into the can. Even under ideal conditions, some liquids and waste get caught in the bottom of the can. Cleaning this waste can be messy because the cans are often deep, making it difficult to get to the bottom of the can easily. Typically, many people hose down the insides of their cans. This is possible only in warm weather making cleaning an infrequent event.

Some trash cans have incorporated system for dispensing bags. Examples of these bags are found in several U.S. Patents. U.S. Pat. No. 4,955,505 discloses a trash can that has a weighted bottom pedestal. Inside the pedestal is a space for a roll of trash can liner bags. The bags exit this pedestal through a slot in the center of the pedestal. This design allows the old bag to pull the new bag up as the old bag is being removed. This patent also uses a foot pedal to prevent the roll of bags from freewheeling while the new bag is being deployed. U.S. Pat. No. 5,295,607 shows a commercial style trash can that has a rectangular storage bin attached to the bottom of the can. This bin holds a roll of trash bags. The bags are dispensed through a horizontal slot in the bin that penetrates into the trash can. This design also uses the full bag to pull a new bag from the roll as the old bag is being removed. U.S. Pat. No. 5,294,017 teaches a recycling bin that has storage space for bag rolls. The bags are again fed through bottom slots and are pulled up when the old bag is removed. U.S. Pat. No. 5,458,259 shows a trash can with a pedestal base that is hinged. The pedestal base holds a roll of bags. New bags are fed through a small hole in the center of the can. Again the new bag is pulled up as the old bag is removed. French Patent 2,701,250 teaches a trash can that has a number of tracks formed along the walls of the can. Here, trash bags with special top edges are used. Guides are formed in these top edges that ride in the tracks. As the bag is pulled up, the tracks cause the bag to open automatically. Clips, placed at the top of the guides, are used to hold the opened bag in position. Finally, U.S. Pat. No. 5,322,179 shows a trash container that has a bottom compartment to hold a roll of bags. A removable inner can that has a slot in the bottom is then placed over the compartment. A bag is run through the slot. The can has a hinged top that has adhesive strips attached. These strips attach to the top of the bag. When the top is opened, the top of the bag is opened. When the top is closed, the top of the bag is closed. The inner can is removable to gain access to the lower portion of the can to replace the roll of bags.

All of these devices (except the French design) suffer from the same design flaw: viz., using a full bag to pull a new bag from the roll. Although this seems logical, it is difficult to maneuver the full bag to easily get to the new bag. Moreover, removing the new bag can be a problem if the bags do not separate easily. It is possible to tear the old bag trying to remove the new bag. Tearing the full bag is not pleasant. The flaw in the French Patent is that it requires the use of special bags. Finally, most of the designs do not have any convenient way of securing the new bag in the can to keep it open.

SUMMARY OF THE INVENTION

The instant invention is a new form of trash receptacle. It has an outer frame that has a hinged lid. The outer frame has a generally hollow interior. At the bottom of the outer frame is a housing designed to hold a large roll of plastic trash bags. The bottom of the housing is fitted with a space to accommodate the lid-lifting mechanism. At the top of the bag housing is a platform that supports a removable inner lining. The lower part of the lining is a rectangular box with a solid bottom and an open top. On top of this box is another rectangular box that has an open top and an open bottom. The top box is designed to interlock with the lower box. Two boxes are used to reduce their size. This allows them to be placed in a household dishwasher for cleaning. An alternative to the rectangular boxes is a set of removable plates. These plates are fit around the inside of the outer frame and can be removed for washing.

As the designs mentioned above, this receptacle also dispenses new trash bags. Unlike the designs mentioned above, this trash receptacle does not keep the replacement bags attached to the bag in use. Instead, the bags are dispensed from the roll through a channel in the back of the frame. A new bag is torn off and the supply of bags remains in this channel, ready for the next replacement. The channel is narrow and tight, which creates sufficient friction to hold the new bags in the channel. The new bag is opened and placed along the top of the frame. Two sets of bag holders, one in the front of the frame and one in the rear, hold the new bag in place. Once the bag is filled, the bag holders are released and the full bag is removed. A new bag is then pulled up from the rear slot as before. If desired, before a new bag is installed, the inner lining boxes can be removed and washed. Finally, the invention includes a locking mechanism to keep the trash bag reel from coming out of its mounts. It is an object of this invention to produce a trash receptacle that has a removable lining that can be washed in a household dishwasher.

It is another object of this invention to produce a trash receptacle that has a convenient system for holding and deploying new trash bags that does not require a full bag of trash to pull the next bag from the dispenser.

It is a further object of this invention to produce a trash receptacle that has a convenient holder for a large number of trash bags.

It is a further object of this invention to produce a trash receptacle that has a convenient method of securing an open trash bag.

It is yet another object of this invention to produce a trash receptacle that has a locking mechanism to keep the trash bag reel from coming out of its mounts.

DETAILED DESCRIPTION OF THE INVENTION

Figure 1:
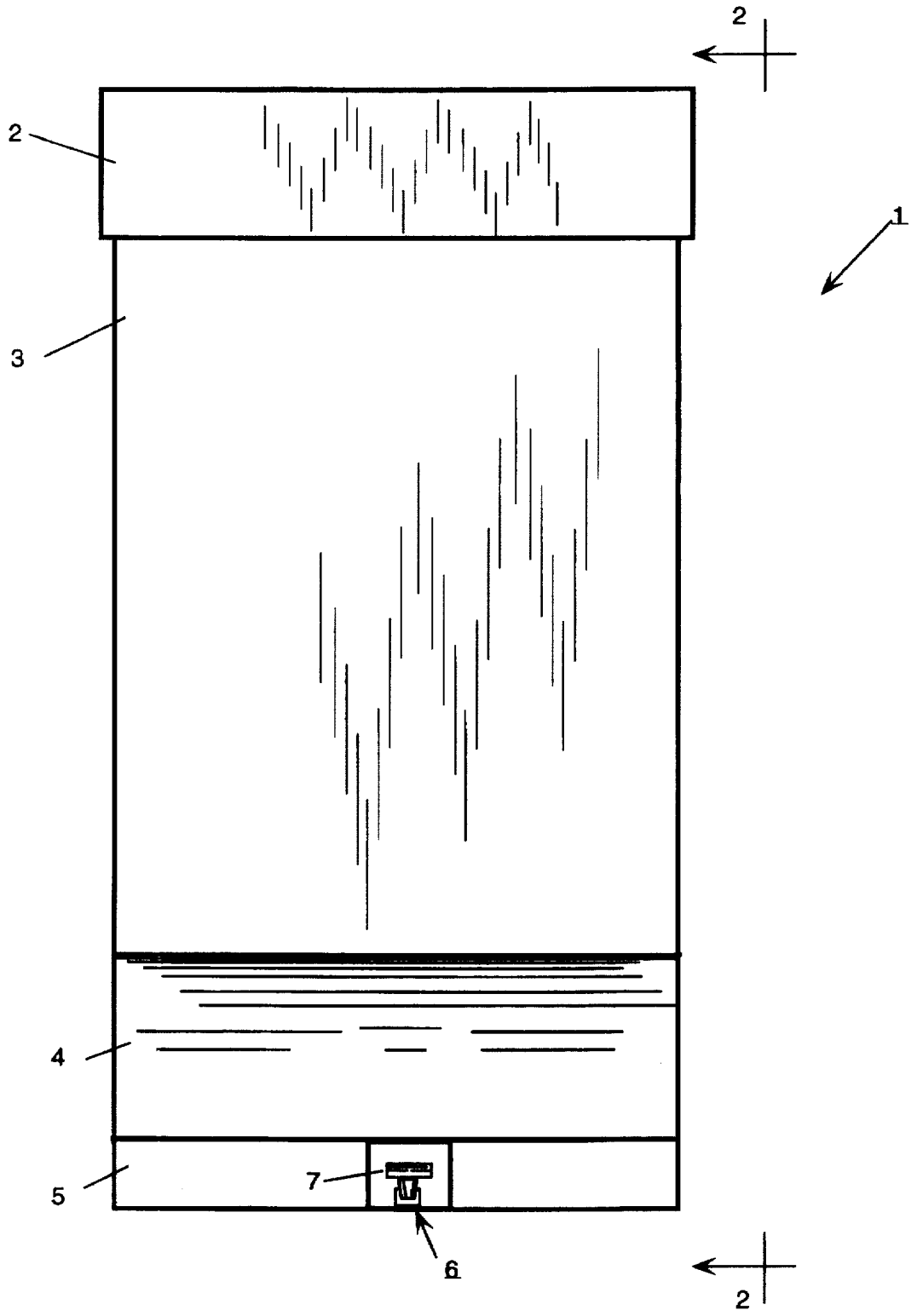
FIG. 1 is a front view of the invention.
Figure 2:
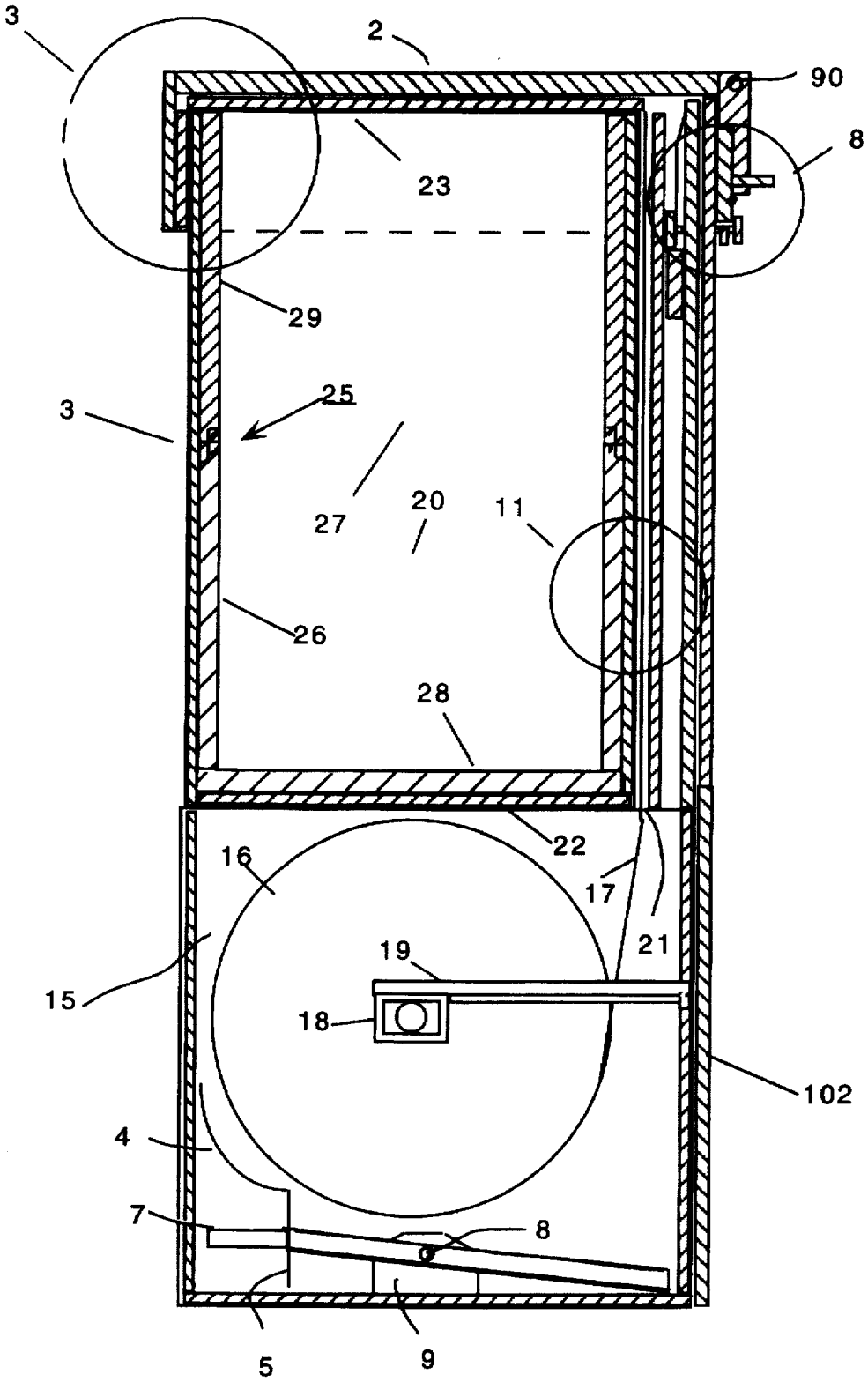
FIG. 2 is a cross-sectional view of the invention taken along the lines 2—2 of FIG. 1.

Referring now to FIG. 1, a trash receptacle 1 is shown. The receptacle 1 is generally rectangular and has a hinged lid 2, an external housing 3, a recessed cover plate 4, a sealing plate 5 and a foot lever system 6 for lifting the lid. Referring now to FIG. 2, the interior details of the trash receptacle 1 are shown. The housing 3 extends down on the sides. The front (as shown in FIG. 1) is cut open and the curved recessed cover plate 4 and sealing plate 5 are shown. Part of the lid lifting system 6 is also shown. A foot pedal 7 is connected to a pivot 8 and a bracket 9. This allows the foot lever 7 to pivot, thereby raising the lid lifting arm 85 (see FIGS. 13 and 17).

The external housing 3 is divided into two compartments: a lower bag housing 15 and an upper trash-holding area 20. Within the lower bag housing 15 is a reel 16 that holds a large quantity of trash bags 17. A locking axle 18 is provided to keep the trash bag reel 16 from coming out of its mounts 19, when a trash bag 17 is pulled upward from the reel 16. A slot 21 is provided to allow the trash bag 17 to pass from the lower bag housing 15 to the upper trash-holding area 20. A plate 22 separates the lower bag housing 15 from the upper trash-holding area 20 as shown. At the rear of the lower housing 15 is an access door 102 that is removed to replace the reel 16 when all of the bags 17 are used. The access door 102 is removed, the old reel 16 is removed, a new reel 16 is installed, and the access door 102 is then replaced.

The upper trash-holding area 20 has an open top that is covered by lid 2. A gasket 23 can be installed around the upper perimeter of the upper trash-holding area 20. The gasket 23 is used to seal the top of the upper trash-holding area 20, to keep odors locked in the receptacle 1. Within the upper trash-holding area 20 is a removable liner 25 that has two parts, in the preferred embodiment. The first is a lower box 26 that supports the bottom of a trash bag 17 that is in current use. The lower box 26 is a rectangular box that has an open top 27 and a sealed bottom 28. The second part is an upper box 29 that has the same length and width as the lower basket 26, but has no top or bottom. The two pieces 26 and 29 are designed to interlock for use. Both parts can be removed from the upper trash-holding area 20 for cleaning. The parts are designed to fit inside an common household dishwasher for cleaning. An alternative to the two boxes is to use a set of separate plates that fit together to form a similar box-like configuration. The plates are not preferred because they require more time to install remove them. Moreover, the need to create many plates can raise the cost of construction considerably.

Figure 11:
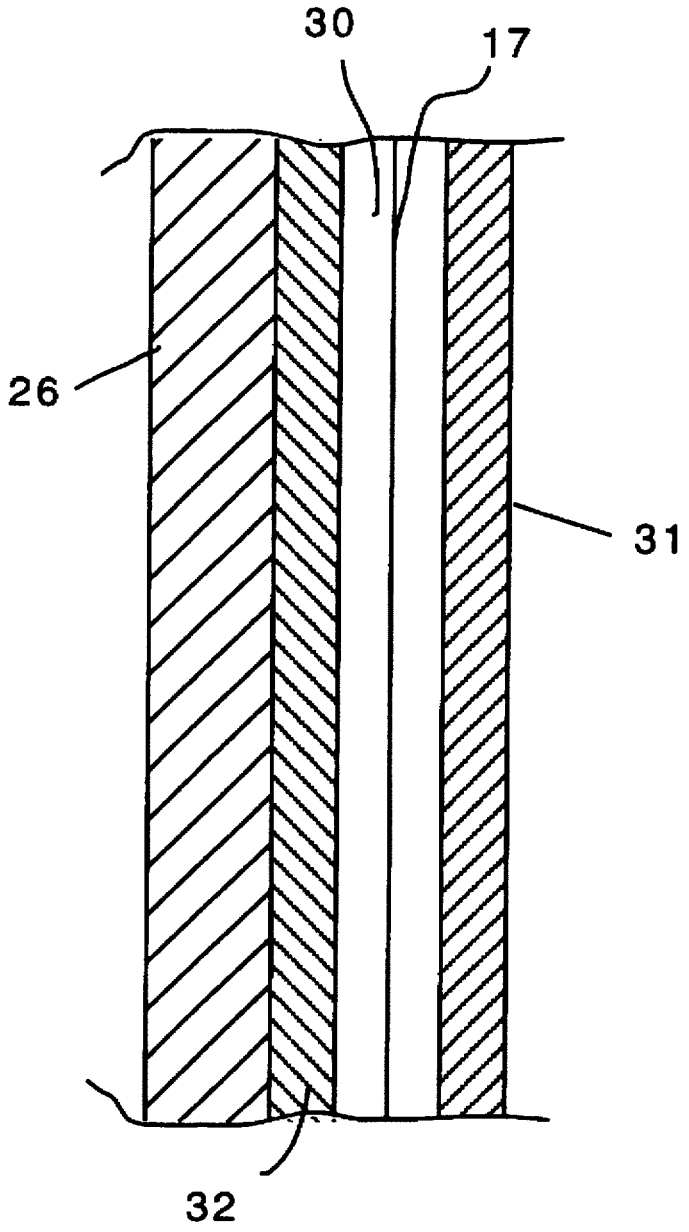
FIG. 11 is a detail view of the rear wall taken about line 11 of FIG. 2.

Referring now to FIGS. 2 and 11, at the back of the housing 3 there are several components. First, there is a small channel 30 that runs between the back wall 31 of the housing 3 and the inner bag holding wall 32. The channel 30 accepts new bags from the reel 16. The new bags 17 are pulled up to the top of the receptacle 1 in this channel. A replacement bag 17 is removed and the remaining bags stay within the channel 30. This is different from prior art designs that use the current bag 17 in use to pull up a new bag 17 when the current bag 17 is removed. As noted above, this method is not preferred because of the problems in handling full bags of trash and the possibility that the bottom of the full bag can be torn open when trying to separate the new bag.

Figure 6:
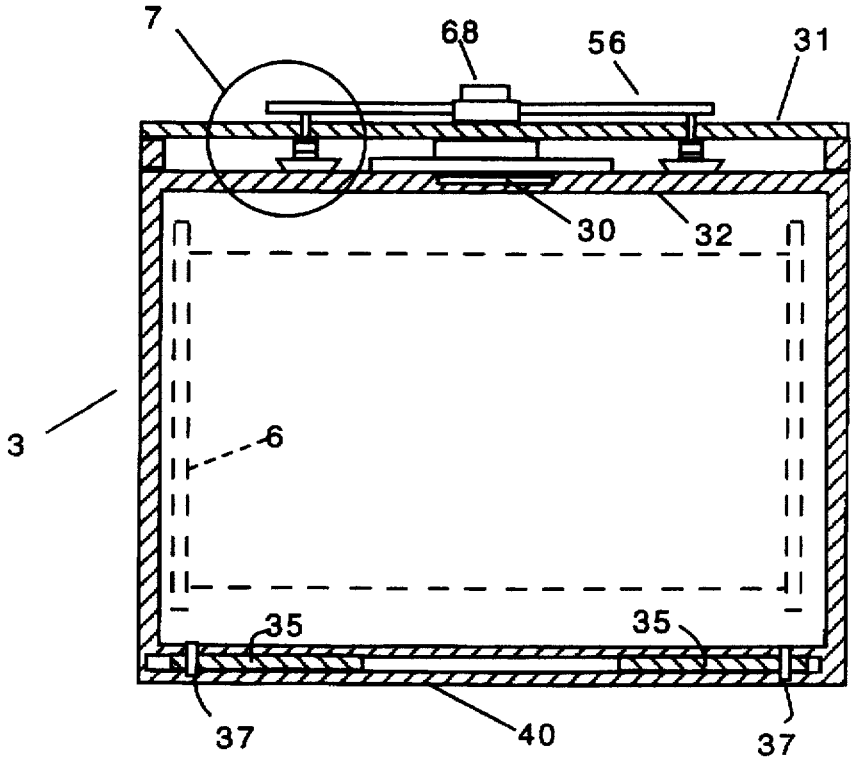
FIG. 6 is a top view of the invention with the lid removed and the inner liner removed.

When a new bag 17 is pulled from the reel 16 for use, it is placed into the upper trash-holding area 20. The bag 17 is then opened and placed over the upper perimeter of the upper trash-holding area 20. Two different systems are used to secure this bag 17 temporarily in place. In the front of the trash receptacle 1 are two rotating panels 35. See FIG. 3. The panels 35 are secured to the front panel 36 of the external housing 3 by pins 37. A wedge portion 38 is secured to the front panel 36. The wedge 38 is designed to fit against the wedge shaped portion 39 of panel 35. See FIG. 3. A front plate 40 is formed in housing 3 to hold pin 37 and to help hide the panels 35 for atheistic appearances. In one embodiment, as shown in FIG. 6, the front plate 40 is actually part of the outer housing 3. A channel 40*a* is formed as shown to hold the panels 35. In another embodiment, the front plate 40 is a separate plate that is attached to the outer housing 3 using attachment means common to the art.

Figure 3:
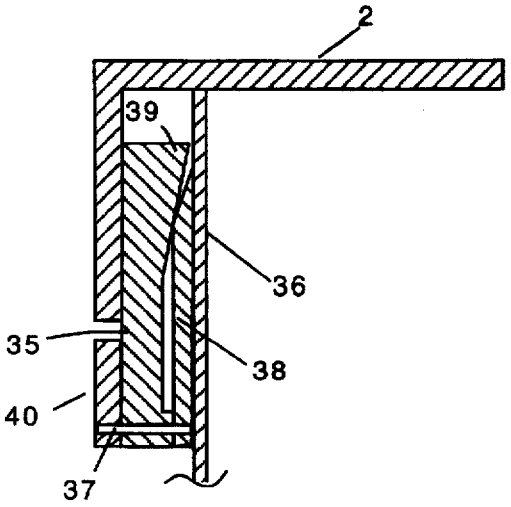
FIG. 3 is a detail view of a front bag holder.
Figure 4:
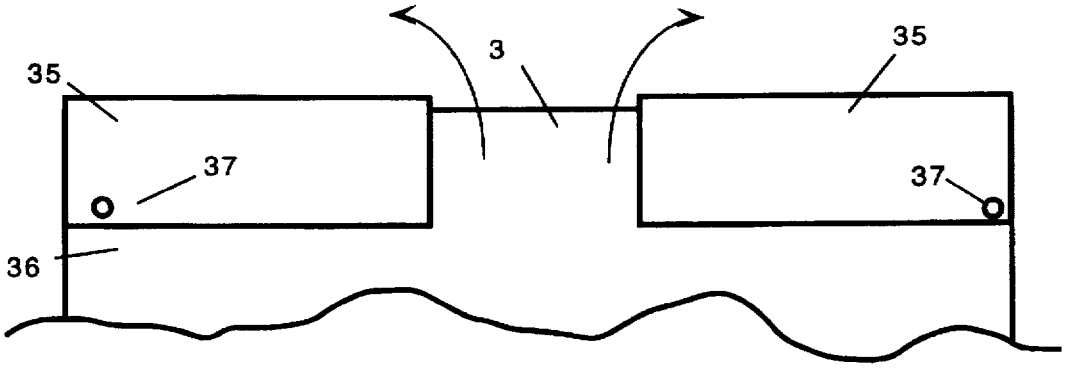
FIG. 4 is a front detail view of the front bag holders in the locked down position.
Figure 5:
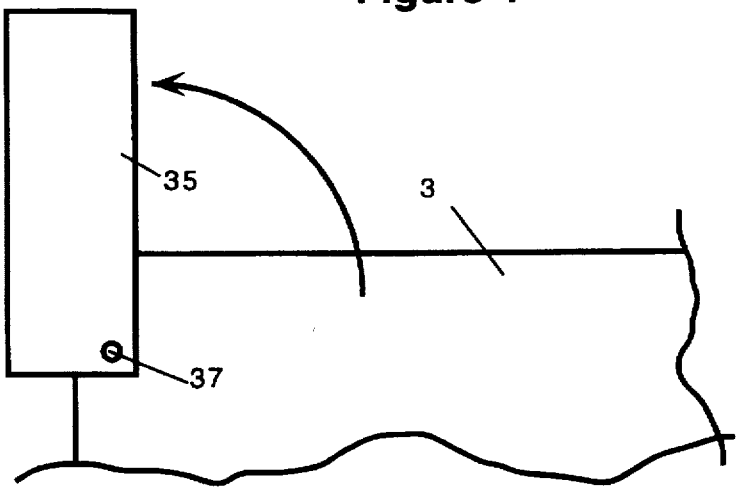
FIG. 5 is a front detail view of one front bag holder shown in the open position, ready to receive a trash bag.

FIG. 3 shows a small gap between the wedge 38 and the panel 35. The open trash bag 17 is fitted into this gap and is held in place by the panel 35. FIG. 4 shows the arrangement of two panels 35 on the trash receptacle 1. The arrows show the direction of pivot for the panels 35. FIG. 5 shows one panel 35 pivoted into the open position. The bag 17 is placed into the opening shown in FIG. 2. The panel is then rotated back to the horizontal as shown in FIG. 4. At this point, the front of the bag 17 is secure. Note that in both of these figures, the front plate 40 is not shown for clarity.

The lid 2 is shown in FIG. 3. The lid is designed to fit over the panels 35 and to be flush with the front plate 40 when the lid 2 is closed.

Figure 7:
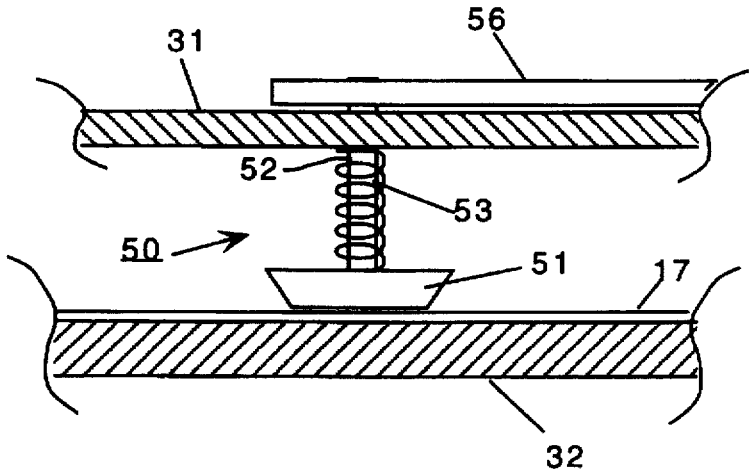
FIG. 7 is a top detail view of one of the rear bag holders.

Referring now to FIGS. 6, 7, 8, 9, and 10, the rear bag holding system is shown. FIG. 6 shows a top view of the device with the inner liner 25 removed. The figures show the various elements that make up the rear bag holding system. Also, the channel 30 is shown. FIG. 7 shows a close-up view of one of the bag holders 50. The bag holder 50 has a front block 51 that is attached to a shaft 52, which is placed inside a spring 53. The shaft 52 passes through a back wall 31 and through a bracket 58. Bracket 58 is shown in FIG. 6. The bracket 58 connects both shafts 52 together (see FIG. 6).

Figure 8:
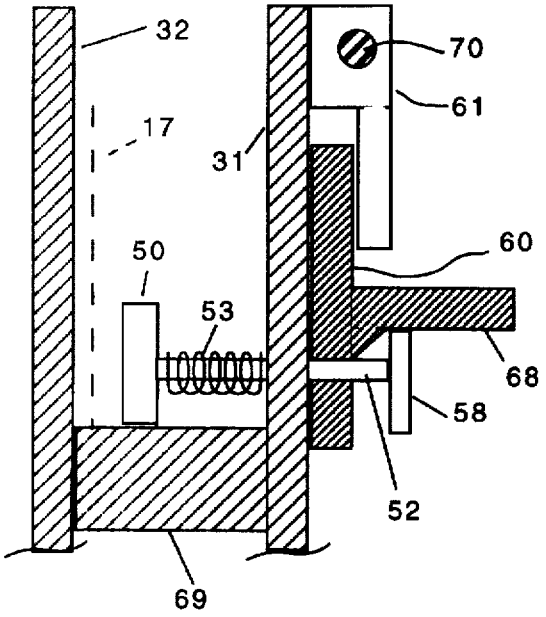
FIG. 8 is a side detail view of one of the rear bag holders shown in the open position taken about line 8 of FIG. 2.
Figure 9:
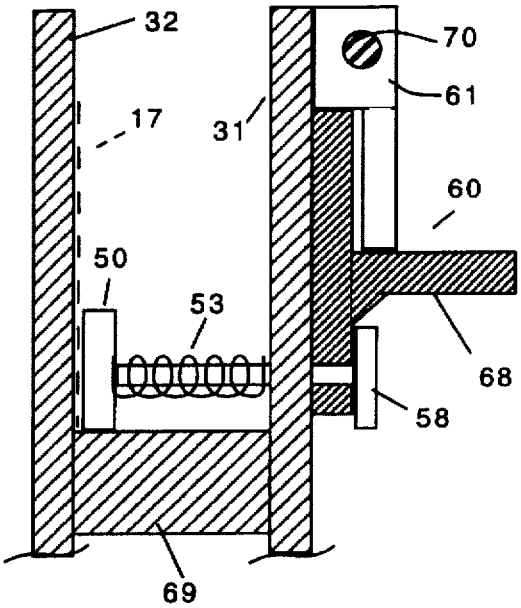
FIG. 9 is a side detail view of one of the rear bag holders shown in the closed position.
Figure 10:
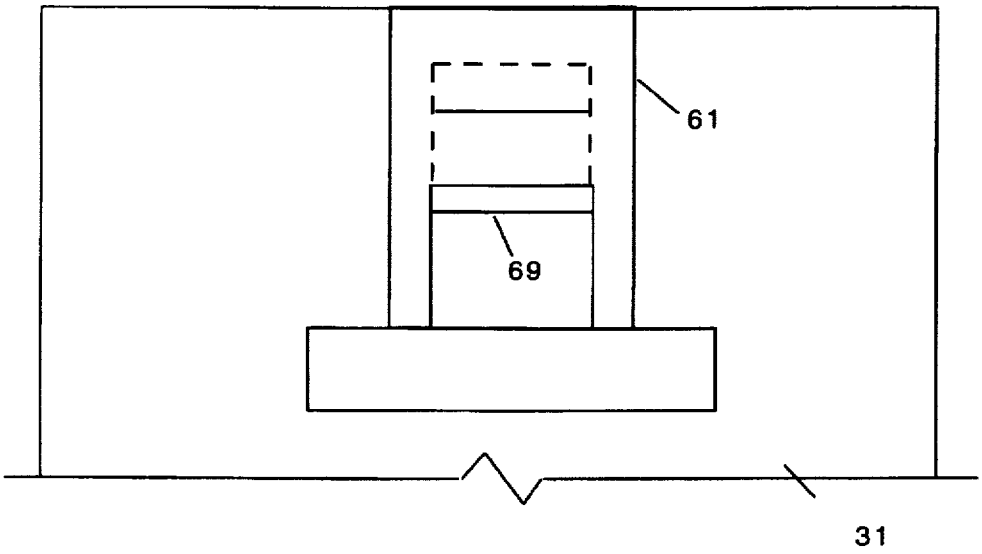
FIG. 10 is a rear detail view of the rear bag holder operating lever.

FIGS. 8 and 9 show the operation of the rear bag holding system. FIG. 8 shows the rear bag holder in the open position. Here, the block 51 is moved away from the inner bag holding wall 32 as shown. A bag 17 is shown hanging in place. The block 51 and shaft 52 are pulled back. As a result, the spring 53 is compressed as shown. The mechanism that causes the bag holders to open is a wedge-shaped operating lever 60. Note that the wedge-shaped operating lever 60 is not shown in FIG. 7 so that the other components can be shown clearly. The bracket 58 rides along the outer edge of the wedge-shaped operating lever 60 as shown. A bracket 61 is used to retain the wedge-shaped operating lever 60 so that it remains in place. Bracket 61 also supports the lid hinge pin 70 as shown. As shown in FIG. 8, the wedge-shaped operating lever 60 is in the down position. The wedge 67 (see FIG. 9) forces the bracket 58 outward, thereby pulling the block 51 back. A handle 68 is used to raise or lower the wedge-shaped operating lever 60. FIG. 9 shows the wedge-shaped operating lever 60 in the up position. Here, the bracket 58 is moved forward by the spring 53. The wedge shape allows the bracket 58 to slide forward as well. In this position, the block 51 is pressed up against the inner bag holding wall 32 as shown. The bag 17 is squeezed between the inner bag holding wall 32 and the blocks 51, thereby holding the bag 17 securely in place. The figures also show a spacer block 69 that is designed to support the rear bag holders and to maintain proper spacing for operation. FIG. 10 is a rear view of the system with the components shown as marked.

Figure 12:
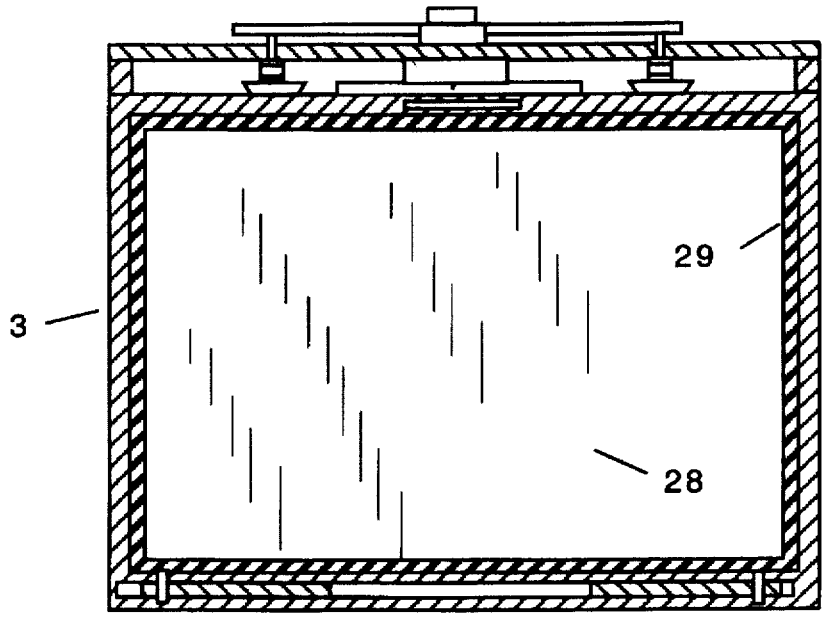
FIG. 12 is a top view of the invention with the lid removed, showing the inner liner.

FIGS. 2 and 12 show details of the inner liner are shown. As discussed above, the inner liner has a top box 29 that has an open top and bottom, and a lower box 26 that has an open top 27 and a sealed bottom 28. The two pieces are stacked inside the outer housing of the refuse container as shown in FIG. 2. FIG. 12 is a top view of the trash can with the inner liner installed. This view shows the solid bottom 28 of the lower liner box 26.

Figure 13:
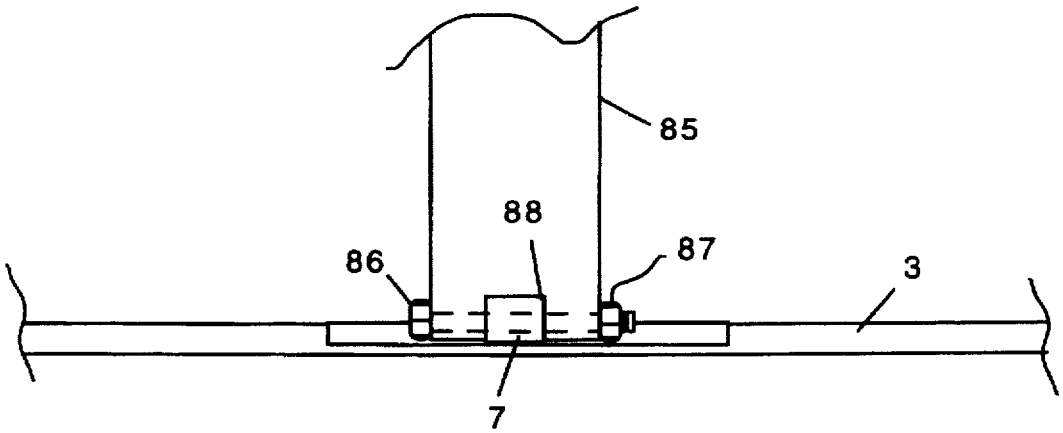
FIG. 13 is a detail view of the bottom of the lid lifting mechanism.
Figure 14:
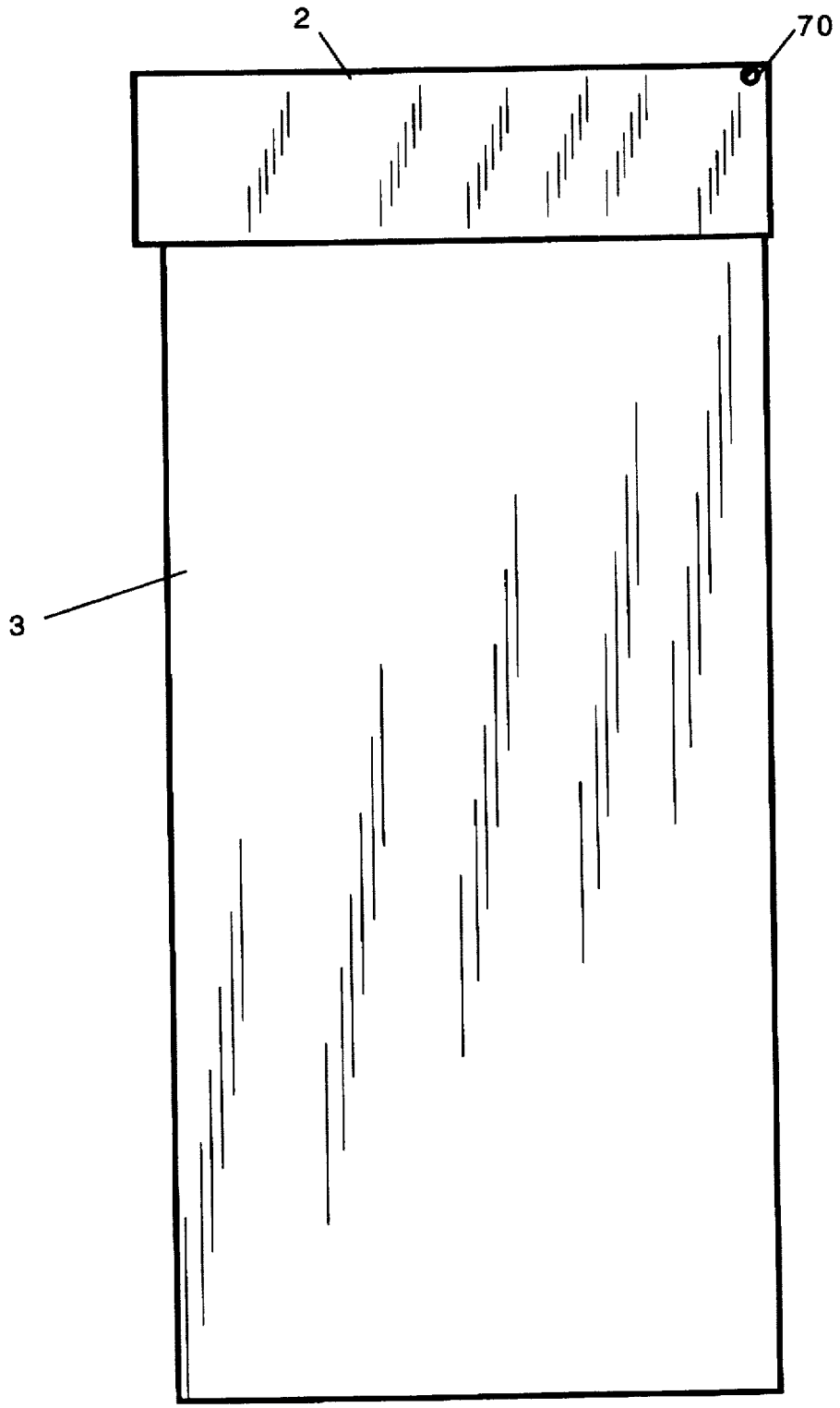
FIG. 14 is a side of the invention showing the lid and hinge.
Figure 17:
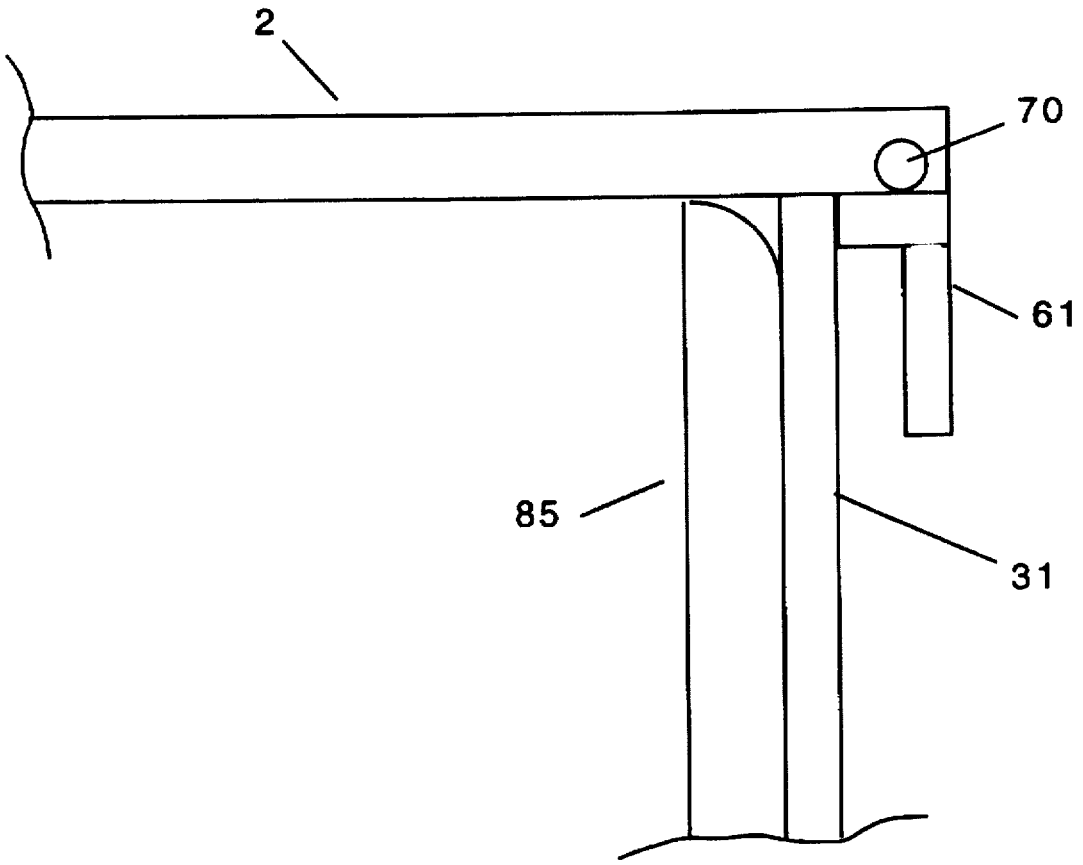
FIG. 17 is a side detail view of the top of the lid lifter.

Referring now to FIGS. 2, 13, 14 and 17, details of the lid and the lid opening system are shown. FIG. 2 shows the foot lever 7, pivot 8 and bracket 9 for the lid opener. The foot lever 7 extends through the back wall 31 of the trash can to be flush with the back of the lid lifter 85. FIG. 13 shows the lower portion of the lid lifter 85. The lid lifter 85 is a rectangular member. FIG. 17 shows a side view of the top of the lid lifter 85. The top of the lid lifter 85 is curved as shown, and rests against the bottom of the lid 2. The bottom of the lid lifter 85 has a notch 88 cut therein to receive the foot lever 7. A bolt 86 penetrates both the lid lifter 85 and foot lever 7 as shown. This bolt 86 and a nut 87 secure the pieces together to ensure they work properly. When the front of the foot lever 7 is depressed, the back of the foot lever 7 is pushed upward. Because it is attached to the bottom of the lid lifter 85, the lid lifter 85 is likewise lifted. As the lid lifter 85 is lifted, it pushes the lid 2 up and open. When the front of the foot lever 7 is released, it rises, causing the back of the foot lever 7 to drop, causing the lid lifter 85 to drop, causing the lid 2 to close. FIG. 14 shows the lid 2 closed. The lid 2 is opened and closed using a hinge pin 70 that runs through the rear of the unit, as discussed above.

The lid lifter 85 is designed to open the lid 2 to an 85° angle, rather than a full 90°. The reason for this is that if the lid 2 was opened to a full 90°, the lid 2 could not be closed when the foot lever 7 is released. Moreover, because the lid lifter 85 only lifts the lid 2 to 85°, the lid 2 must be removed to allow the lid lifter 85 to be removed to gain access to the reel 16. For this reason, the reel 16 s designed to hold a supply of bags that should last from one to two years. This reduces the need to change the reel 16, which is a somewhat cumbersome task.

Figure 15:
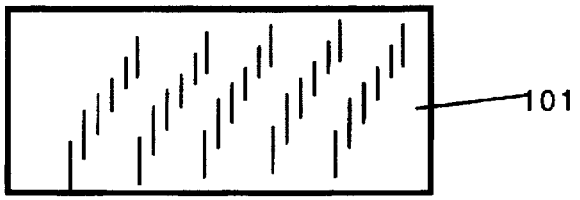
FIG. 15 is front view of a removable liner plate.
Figure 16:
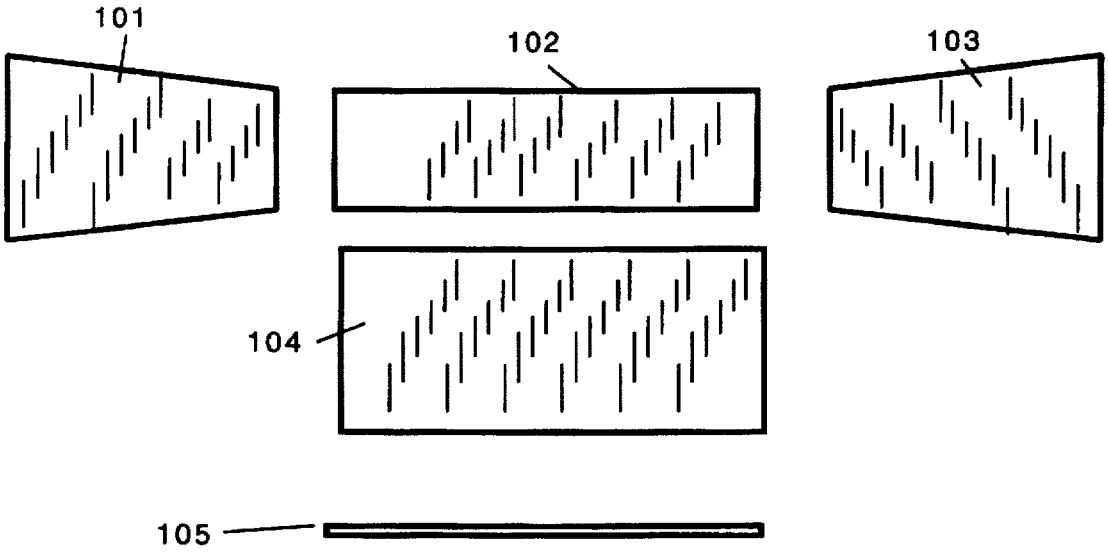
FIG. 16 is a perspective exploded view of the removable liner plates in an installed configuration.

Referring now to FIG. 15 and 16, an alternative to the box-style inner liners is shown. Here, individual plates are used to line the interior of the trash receptacle. FIG. 15 shows one typical plate 101. The plate 101 is generally rectangular as shown. The top section of the liner uses four plates 101 that make an open box configuration such as that shown in FIG. 16, using plates 101 through 104. The lower liner uses four more plates 101 through 104, as before, but also adds a bottom plate 105 as shown in FIG. 16. These plates can be made of porcelain or other suitable material.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A trash receptacle, for holding a removable trash bag, comprising:

a) an outer frame having a front and a back;

b) a removable inner liner, including i) an upper box portion, having an open top and an open bottom, and ii) a lower box portion, having an open top and a closed bottom, said removable inner liner being removably disposed within said outer frame; and c) means for securing said removable trash bag within said removable inner liner.

2. The trash receptacle of claim 1 wherein the upper box portion and lower box portion of said removable inner liner are interlocking.

3. The trash receptacle of claim 1 further comprising a means for dispensing a supply of trash bags, operably installed within said outer frame.

4. The trash receptacle of claim 1 wherein the means for securing said removable trash bag comprise a front portion, operable attached to the front of said outer frame; and a back portion, operably attached to the back of said outer frame.

5. The trash receptacle of claim 4 wherein the front portion of said means for securing said removable trash bag comprise a pair of plates, having a closed position and an open position, rotatably attached to the front of said outer frame, whereby said pair of plates hold said removable trash bag by friction in the closed position and release the removable trash bag in the open position.

6. The trash receptacle of claim 4 wherein the back portion of said means for securing said removable trash bag comprise: a pair of blocks, having shafts, extending outwardly therefrom; a trip plate, fixedly attached to said shafts, a means for operably engaging said trip plate, whereby when said trip plate is in an open position, said shafts are pulled away from an inner bag holding wall, causing said pair of blocks to move away from said inner bag holding wall, thereby creating a gap between said pair of blocks and said inner bag holding wall and when said trip plate is in a closed position, said shafts and said pair of blocks are moved forward against said inner bag holding wall; such that in the open position, a removable trash bag can be inserted into said gap, and when in the closed position, said removable trash bag is secured by said pair of blocks.

7. The trash receptacle of claim 1 further comprising a lid, hingably attached to said outer frame.

8. The trash receptacle of claim 7 further comprising a means for lifting said lid, operably attached to said outer frame and said lid.

9. The trash receptacle of claim 8 wherein the means for lifting said lid includes a foot lever.

10. A trash receptacle for holding a removable trash bag, comprising:

a) an outer frame having a front and a back and having inside dimensions;

b) a removable inner liner, including a set of flat plates, said set of flat plates forming a box having an open top and a closed bottom and having four side walls that conform the inside dimensions of the outer frame, said set of flat plates being interlocking and being removable from said outer frame; and c) a means for securing said removable trash bag within said removable inner liner.

11. The trash receptacle of claim 10 further comprising a means for dispensing a supply of trash bags, operably installed within said outer frame.

12. The trash receptacle of claim 10 wherein the means for securing said removable trash bag comprise a front portion, operable attached to the front of said outer frame; and a back portion, operably attached to the back of said outer frame.

13. The trash receptacle of claim 12 wherein the front portion of said means for securing said removable trash bag comprise a pair of plates, having a closed position and an open position, rotatably attached to the front of said outer frame, whereby said pair of plates hold said removable trash bag by friction in the closed position and release the removable trash bag in the open position.

14. The trash receptacle of claim 12 wherein the back portion of said means for securing said removable trash bag comprise: a pair of blocks, having shafts, extending outwardly therefrom; a trip plate, fixedly attached to said shafts, a means for operably engaging said trip plate, whereby when said trip plate is in an open position, said shafts are pulled away from an inner bag holding wall, causing said pair of blocks to move away from said inner bag holding wall, thereby creating a gap between said pair of blocks and said inner bag holding wall, and when said trip plate is in a closed position, said shafts and said pair of blocks are moved forward against said inner bag holding wall; such that in the open position, a removable trash bag can be inserted into said gap, and when in the closed position, said removable trash bag is secured by said pair of blocks.

15. The trash receptacle of claim 10 further comprising a lid, hingably attached to said outer frame.

16. The trash receptacle of claim 15 further comprising a means for lifting said lid, operably attached to said outer frame and said lid.

17. A trash receptacle for holding a removable trash bag, comprising:

a) an outer frame having a front and a back, and a top;

b) a removable inner liner, including i) an upper box portion, having an open top and an open bottom, and ii) a lower box portion, having an open top and a closed bottom, said removable inner liner being removably disposed within said outer frame and further such that the upper box portion and lower box portion of said removable inner liner are interlocking;

c) a means for securing said removable trash bag within said removable inner liner; and d) a means for dispensing a supply of trash bags, including a reel, having a plurality of trash bags stored thereon; a pair of mounts, to support said reel, a means for deploying said plurality of trash bags from said reel to the top of said outer frame, and a means for locking said reel to prevent said reel from coming off of said pair of mounts.

18. The trash receptacle of claim 17 further comprising: a lid, hingably attached to said outer frame; and a means for lifting said lid, operably attached to said outer frame and said lid, including a foot lever.

19. The trash receptacle of claim 17 wherein the means for securing said removable trash bag comprise:

a) a pair of plates, having a closed position and an open position, rotatably attached to the front of said outer frame, whereby said pair of plates hold said removable trash bag by friction in the closed position and release the removable trash bag in the open position;

b) a pair of blocks, having shafts, extending therefrom; and c) a trip plate, fixedly attached to said shafts, a means for operably engaging said trip plate, whereby when said trip plate is in an open position, said shafts are pulled away from an inner bag holding wall, causing said pair of blocks to move away from said inner bag holding wall, thereby creating a gap between said pair of blocks and said inner bag holding wall, and when said trip plate is in a closed position, said shafts and said pair of blocks are moved forward against said inner bag holding wall; such that in the open position, a removable trash bag can be inserted into said gap, and when in the closed position, said removable trash bag is secured by said pair of blocks.

* * * * *